US011107385B2

(12) United States Patent
Kim et al.

(10) Patent No.: US 11,107,385 B2
(45) Date of Patent: Aug. 31, 2021

(54) DISPLAY DEVICE

(71) Applicant: SAMSUNG DISPLAY CO., LTD., Yongin-si (KR)

(72) Inventors: Soo Yeon Kim, Yongin-si (KR); Ji Ye Lee, Yongin-si (KR); Hee Jeong Seo, Yongin-si (KR); Tae Gon Im, Yongin-si (KR); Jung Hwan Cho, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/938,329

(22) Filed: Jul. 24, 2020

(65) Prior Publication Data

US 2021/0201734 A1 Jul. 1, 2021

(30) Foreign Application Priority Data

Dec. 31, 2019 (KR) ..... 10-2019-0179030

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01)

(58) Field of Classification Search
CPC ..... G09G 5/008; G09G 3/20; G09G 3/3688; G09G 2330/12; G09G 2320/0295
See application file for complete search history.

(56) References Cited

U.S. PATENT DOCUMENTS

2011/0157132 A1* 6/2011 Byun ..... G09G 3/3677 345/211
2012/0032941 A1* 2/2012 Chen ..... G09G 3/3677 345/212
2014/0085174 A1* 3/2014 Inoue ..... G09G 3/3655 345/87
2015/0221275 A1* 8/2015 Shin ..... G09G 3/3648 345/214
2016/0189621 A1* 6/2016 Kim ..... G09G 3/3258 345/215
2016/0189625 A1* 6/2016 Kim ..... G09G 3/3233 345/205
2016/0351129 A1* 12/2016 Kim ..... G09G 3/3258
(Continued)

FOREIGN PATENT DOCUMENTS

KR 1020170053370 A 5/2017
KR 1020180032740 A 4/2018

*Primary Examiner* — Gerald Johnson
(74) *Attorney, Agent, or Firm* — Cantor Colburn LLP

(57) ABSTRACT

A display device includes a timing controller which supplies a clock training signal through a data clock signal line and a first control signal through a shared signal line in a first period of one frame, and supplies image data through the data clock signal line in a second period of the one frame, a data driver provided with data driving circuits which generate a clock signal based on the clock training signal and the first control signal in the first period, and generate data voltages based on the clock signal and the image data in the second period, and a pixel part which receives the data voltages from the data driver. The data driver may supply a second control signal indicating a reception state of the data driver to the timing controller through the shared signal line in the second period.

20 Claims, 7 Drawing Sheets

(56) References Cited

U.S. PATENT DOCUMENTS

| | | | | |
|---|---|---|---|---|
| 2017/0132966 | A1 | 5/2017 | Lim et al. | |
| 2018/0122294 | A1* | 5/2018 | Do | G09G 3/3225 |
| 2020/0294453 | A1* | 9/2020 | Watanabe | G09G 3/3688 |

* cited by examiner

DISPLAY DEVICE

This application claims priority to Korean Patent Application No. 10-2019-0179030, filed on Dec. 31, 2019, and all the benefits accruing therefrom under 35 U.S.C. § 119, the content of which in its entirety is herein incorporated by reference.

BACKGROUND

(a) Field

Exemplary embodiments of the invention relate to a display device.

(b) Description of the Related Art

A display device generally includes a timing controller and a data driver. The timing controller supplies a clock training signal to the data driver through an interface such as a unified standard interface for TV ("USI-T"), and supplies a training notification signal to the data driver through a shared forward channel ("SFC") in a vertical blank period. In addition, the timing controller supplies image data to the data driver through an interface in an active data period.

The data driver generally includes a clock data recovery ("CDR") circuit which generates a clock signal from the clock training signal supplied from the timing controller when the training notification signal is received through the SFC in the vertical blank period. In addition, the data driver generates data voltages in the active data period based on the generated clock and the image data supplied from the timing controller.

Further, the data driver provides a feedback signal to the timing controller when a lock fail of the clock signal occurs due to electrostatic discharge ("ESD") stress or the like in the active data period. The timing controller re-supplies the clock training signal to the data driver based on the feedback signal provided from the data driver, and thus the data driver immediately restores the clock signal. To this end, a shared back channel for providing the feedback signal is desired between the timing controller and the data driver.

SUMMARY

Exemplary embodiments of the invention have been made in an effort to provide a display device that may reduce the number of channels by transmitting a first control signal for notifying supply of a clock training signal and a second control signal for indicating a reception state of a data driver through a shared signal line, which is one bidirectional signal channel.

An exemplary embodiment of the invention provides a data clock signal line, a shared signal line, a display device including a timing controller supplying a clock training signal through the data clock signal line and a first control signal through the shared signal line in a first period of one frame, and supplying image data through the data clock signal line in a second period of the one frame, a data driver provided with data driving circuits generating a clock signal based on the clock training signal and the first control signal in the first period, and generating data voltages based on the clock signal and the image data in the second period, and a pixel part receiving the data voltages from the data driver, wherein the data driver may supply a second control signal indicating a reception state of the data driver to the timing controller through the shared signal line in the second period.

In an exemplary embodiment, the timing controller may re-supply the clock training signal to the data driver through the data clock signal line based on the second control signal in the second period.

In an exemplary embodiment, the timing controller may supply the first control signal of a first level to the data driver through the shared signal line in a first time duration of the first period, and may supply the first control signal of a second level higher than the first level to the data driver through the shared signal line in a second time duration of the first period different from the first time duration.

In an exemplary embodiment, the data driver may generate the clock signal based on the clock training signal and the first control signal of the first level in the first time duration of the first period.

In an exemplary embodiment, the timing controller may be commonly connected to the data driving circuits through the shared signal line.

In an exemplary embodiment, when the reception state is normal in the second period, the data driver may supply the second control signal of a third level to the timing controller through the shared signal line, and when the reception state is abnormal in the second period, the data driver may supply the second control signal of a fourth level lower than the third level to the timing controller through the shared signal line.

In an exemplary embodiment, when the second control signal of the fourth level is supplied from the data driver in the second period, the timing controller may stop the supply of the image data, and may re-supply the clock training signal to the data driver through the data clock signal line.

In an exemplary embodiment, when the clock training signal is re-supplied from the timing controller in the second period, the data driver may stop generation of the data voltages, and may re-generate the clock signal based on the re-supplied clock training signal.

In an exemplary embodiment, when the second control signal of the third level is supplied from the data driver in the second period, the timing controller may hold the supply of the image data.

In an exemplary embodiment, when the data driver supplies the second control signal of the third level to the timing controller in the second period, the data driver may generate the data voltages based on the clock signal and the image data.

In an exemplary embodiment, the abnormal state may be based on a lock fail of the clock signal.

In an exemplary embodiment, the shared signal line may include sub-shared signal lines, and the timing controller may be connected to the data driving circuits through the sub-shared signal lines, respectively.

In an exemplary embodiment, a first data driving circuit of the data driving circuits, in which the reception state is normal in the second period, may supply the second control signal of a third level to the timing controller through a first sub-shared signal line of the sub-shared signal lines, and a second data driving circuit of the data driving circuits, in which the reception state is abnormal in the second period, may supply the second control signal of a fourth level lower than the third level to the timing controller through a second sub-shared signal line of the sub-shared signal lines.

In an exemplary embodiment, the timing controller may stop the supply of the image data to the data driving circuits, which supplies the second control signal of the fourth level, and may re-supply the clock training signal through the data clock signal line, in the second period.

In an exemplary embodiment, the data driving circuits re-supplied with the clock training signal in the second period may stop the generation of the data voltages, and may regenerate the clock signal based on the re-supplied clock training signal.

In an exemplary embodiment, the timing controller may hold the supply of the image data to the data driving circuits supplying the second control signal of the third level in the second period.

In an exemplary embodiment, the data driving circuits supplying the second control signal of the third level to the timing controller in the second period may generate the data voltages based on the clock signal and the image data.

In an exemplary embodiment, the shared signal line may be able to transmit a bidirectional signal between the timing controller and the data driver.

In an exemplary embodiment, the timing controller may be commonly connected to the data driving circuits through the data clock signal line.

In an exemplary embodiment, the data clock signal line may include sub-data clock signal lines, and the timing controller may be connected to the data driving circuits through the sub-data clock signal lines, respectively.

The display device in the exemplary embodiment may transmit a first control signal for notifying supply of a clock training signal and a second control signal for indicating a reception state of a data driver between a timing controller and the data driver through a shared signal line, which is one bidirectional signal channel, without using different signal channels. Accordingly, it is possible to reduce the number of signal channels for transmitting the first control signal and the second control signal.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
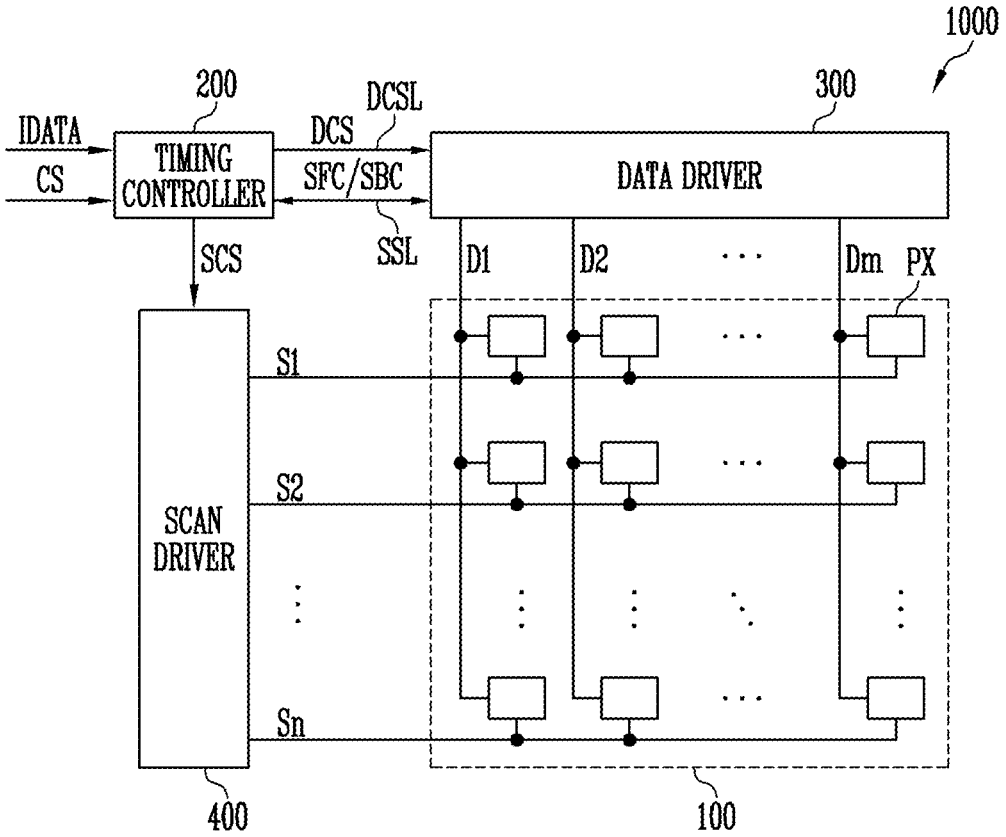
FIG. 1 illustrates a schematic view for describing an exemplary embodiment of a display device according to the invention.

Since the invention may be variously modified and have various forms, exemplary embodiments will be illustrated and described in detail in the following. This, however, by no means restricts the invention to the specific embodiments, and it is to be understood as embracing all included in the spirit and scope of the invention changes, equivalents, and substitutes.

Like reference numerals are used for like constituent elements in describing each drawing. In the accompanying drawings, the dimensions of the structure are exaggerated and shown for clarity of the invention. Terms such as first, second, and the like will be used only to describe various constituent elements, and are not to be interpreted as limiting these constituent elements. The terms are only used to differentiate one constituent element from other constituent elements. A first constituent element could be termed a second constituent element, and similarly, a second constituent element could be termed as a first constituent element, for example, without departing from the scope of the invention. Singular forms are intended to include plural forms unless the context clearly indicates otherwise.

In the application, it should be understood that the term "include", "comprise", "have", or "configure" indicates that a feature, a number, a step, an operation, a constituent element, a part, or a combination thereof described in the specification is present, but does not exclude a possibility of presence or addition of one or more other features, numbers, steps, operations, constituent elements, parts, or combinations, in advance.

In addition, when it is described that an element is "coupled" to another element, the element may be "directly coupled" to the other element or "electrically coupled" to the other element through a third element.

Hereinafter, exemplary embodiments of the invention will be described in detail with reference to the accompanying drawings.

FIG. 1 illustrates a schematic view for explaining an exemplary embodiment of a display device according to the invention.

Referring to FIG. 1, the display device 1000 may include a pixel part 100, a timing controller 200, a data driver 300, and a scan driver 400.

The pixel part 100 may include scan lines S1 to Sn, data lines D1 to Dm, and pixels PX. Here, n and m are natural numbers.

The pixels PX may be connected to at least one of the scan lines S1 to Sn and at least one of the data lines D1 to Dm. The pixels PX may receive scan signals through the scan lines S1 to Sn and data voltages through the data lines D1 to Dm. The pixels PX may emit light with grays corresponding to the data voltages based on the scan signals and the data voltages.

The timing controller 200 may receive a control signal CS and input image data IDATA from an external device (for example, a graphics processor). The timing controller 200 may generate a scan control signal SCS based on the control signal CS, and generate a data control signal DCS based on the control signal CS and the input image data IDATA. In this case, the control signal CS may include a vertical synchronization signal, a horizontal synchronization signal, and the like.

The data control signal DCS may include at least one of a clock training signal and image data. Here, the clock training signal may include a clock training pattern, and the image data may include pixel data and the like.

In the exemplary embodiment, the timing controller 200 may supply the clock training signal through a data clock signal line DCSL in a first period of one frame, and may supply the image data through the data clock signal line DCSL in a second period of one frame. In an exemplary embodiment, the data clock signal line DCSL may be a high speed serial interface, for example. In an exemplary embodiment, the data clock signal line DCSL may be a universal serial interface ("USI"), a universal serial interface for TV ("USI-T"), or a universal description, discovery and integration ("UDDI"), for example.

In an exemplary embodiment, the first period and the second period may be different periods. The first period may be a vertical blank period VBP (refer to FIGS. 4A and 4B), and the second period may be an active data period ADP (refer to FIGS. 4A and 4B). Hereinafter, the vertical blank period VBP may be also referred to as a first period VBP and the active data period ADP may be also referred to as a second period ADP for convenience. The vertical blank period VBP may be a transition period in which image data is not supplied and proceeds to a next frame. The active data period ADP may be a supply period of image data corresponding to an image to be displayed by the pixel part 100.

The timing controller 200 may supply a first control signal SFC (or a training notification signal) through a shared signal line SSL to notify the clock training signal supply in the first period.

In the exemplary embodiment, the timing controller 200 may supply the clock training signal through the data clock signal line DCSL in at least one time duration of the first period. Here, in at least one time duration of the first period (or a period in which the timing controller 200 supplies the clock training signal through the data clock signal line DCSL during the first period), the timing controller 200 may supply a first control signal SFC of a first level through the shared signal line SSL. In addition, in a remaining time duration of the first period (or a period in which the timing controller 200 does not supply the clock training signal through the data clock signal line DCSL during the first period), the timing controller 200 may supply the first control signal SFC of a second level higher than the first level through the shared signal line SSL. The timing controller 200 may not supply the first control signal SFC to the data driver 300 in the second period. In an exemplary embodiment, the first level may be a logic low level, and the second level may be a logic high level, for example.

The data driver 300 may receive the data control signal DCS from the timing controller 200 through the data clock signal line DCSL in the first and second periods, and may receive the first control signal SFC of the first level (or logic low level) from the timing controller 200 through the shared signal line SSL in the first period. In the exemplary embodiment, the data driver 300 may receive the clock training signal from the timing controller 200 through the data clock signal line DCSL in at least one time duration of the first period, may receive the first control signal SFC of the first level (or logic low level) from the timing controller 200 through the shared signal line SSL, and may receive the image data from the timing controller 200 through the data clock signal line DCSL in the second period.

The data driver 300 may generate the clock signal based on the clock training signal supplied from the timing controller 200 and the first control signal SFC of the first level (or logic low level) in the first period. In an exemplary embodiment, the data driver 300 may include a clock data recovery ("CDR") circuit, and the CDR circuit may generate a clock signal from the clock training signal supplied from the timing controller 200 when the first control signal SFC of the first level (or logic low level) is received from the timing controller 200 in the first period, for example.

The data driver 300 may generate data voltages based on the image data supplied from the timing controller 200 and the clock signal generated in the first period, in the second period, and may provide the data voltages to the data lines D1 to Dm.

In the exemplary embodiment, the data driver 300 may supply a second control signal SBC (or feedback signal) indicating a reception state of the data driver 300 to the timing controller 200 through the shared signal line SSL in the second period. In an exemplary embodiment, in the second period, when the reception state of the data driver 300 is in a normal state, the data driver 300 may supply the second control signal SBC of a third level to the timing controller 200 through the shared signal line SSL, and when the reception state of the data driver 300 is in an abnormal state, the data driver 300 may supply the second control signal SBC of a fourth level lower than the third level to the timing controller 200 through the shared signal line SSL, for example. In an exemplary embodiment, the third level may be a logic high level, and the fourth level may be a logic low level, for example. Here, the state in which the reception state is abnormal may mean a state in which the clock signal is a lock fail by an electrostatic discharge ("ESD") or the like. The data driver 300 may not supply the second control signal SBC to the timing controller 200 in the first period.

Here, the data driver 300 may supply the second control signals SBC to the timing controller 200 through the same line as the shared signal line SSL which is a line to which the first control signal SFC is supplied from the timing controller 200, without using a separate line (or channel). To this end, the shared signal line SSL may allow bidirectional signal transmission between the timing controller 200 and the data driver 300. In an exemplary embodiment, the timing controller 200 and the data driver 300 may include a bidirectional serial communication port, for example, an inter-integrated circuit ("I2C"), for example.

In the second period, the timing controller 200 may re-supply the clock training signal to the data driver 300 through the data clock signal line DCSL based on the second control signal SBC supplied from the data driver 300.

In the exemplary embodiment, when the timing controller 200 receives the second control signal SBC of the fourth level (or logic low level) from the data driver 300 in the second period, the timing controller 200 may stop the supply of the image data through the data clock signal line DCSL, and may re-supply the clock training signal to the data driver 300 through the data clock signal line DCSL. In this case, the data driver 300 may regenerate the clock signal based on the clock training signal re-supplied from the timing controller 200. The signals (for example, the data control signal DCS, the first control signal SFC, the second control signal SBC, etc.) transmitted between the timing controller 200 and the data driver 300, and configurations of the timing controller 200 and the data driver 300 will be described later with reference to FIGS. 2 to 4B.

The scan driver 400 may generate the scan signals based on the scan control signal SCS provided from the timing controller 200. In an exemplary embodiment, the scan control signal SCS may include a scan start signal, a scan clock signal, and the like, for example. The scan driver 400 may sequentially provide the scan signals to the scan lines S1 to Sn. In an exemplary embodiment, the scan driver 400 may sequentially provide the scan signals having pulses of a turn-on level to the scan lines S1 to Sn, for example. In the exemplary embodiment, the scan driver 400 may generate the scan signals by sequentially transmitting the turn-on level pulse to a next scan stage according to the scan clock signal. In an exemplary embodiment, the scan driver 400 may be configured in a form of a shift register, for example.

Figure 2:
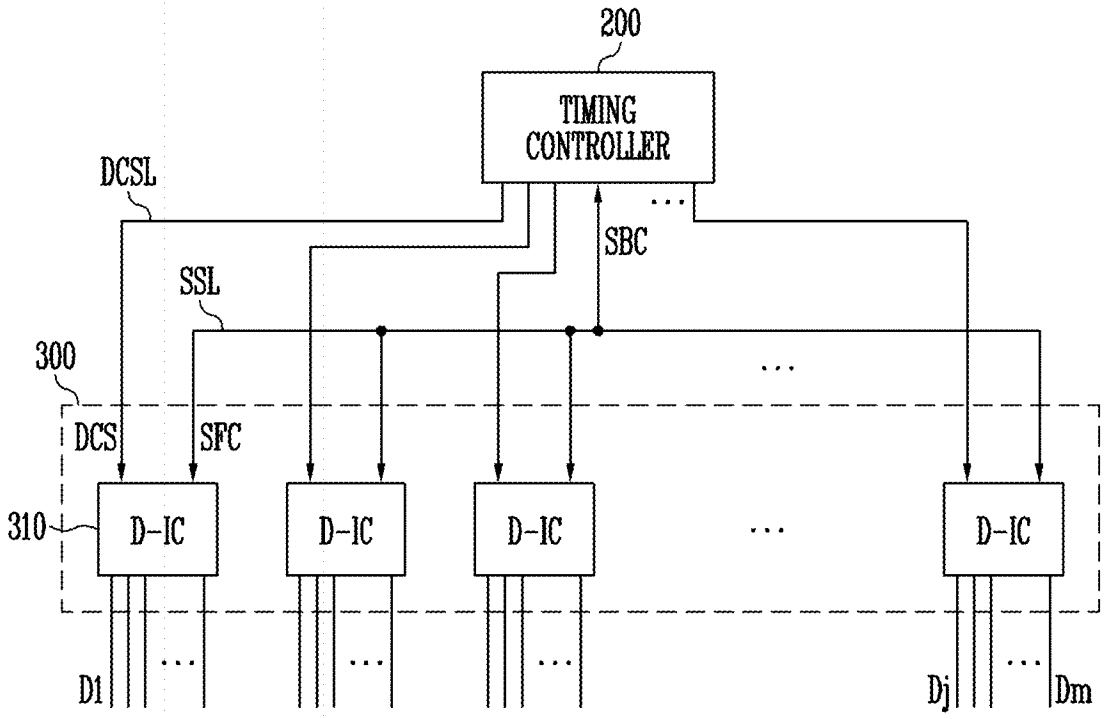
FIG. 2 illustrates an exemplary embodiment of a timing controller, a data driver, and a data clock signal line and a shared signal line connecting the timing controller and the data driver included in the display device of FIG. 1.

FIG. 2 illustrates an exemplary embodiment of a timing controller, a data driver, and a data clock signal line and a shared signal line connecting the timing controller and the data driver included in the display device of FIG. 1.

Referring to FIG. 2, the data driver 300 may include data driving circuits 310. The data driving circuits 310 may be also referred to as a driver IC ("D-IC") or a source IC.

The data driving circuits 310 may be connected to at least one of the data lines D1 to Dm. In an exemplary embodiment, when the data driver 300 includes only one data driving circuit 310, the data driving circuit 310 and the data driver 300 may be the same, for example. In this case, all of the data lines D1 to Dm may be connected to one data driving circuit 310. In another exemplary embodiment, when the data driver 300 includes a plurality of data driving circuits 310, the data lines D1 to Dm may be grouped, and each data line group may be connected to a corresponding data driving circuit 310. In the exemplary embodiment, the data driver 300 may include m data driving circuits 310, and in this case, the data line groups each include one data line, so that the m data driving circuits 310 include m data lines D1 to Dm (or data line groups), respectively, for example. In another exemplary embodiment, the data driving circuits 310 may include m/4 data driving circuits 310, and in this case, the data line groups each include four data lines, so that each of the m/4 data driving circuits 310 may be connected to four data lines (or data line groups) among the m data lines D1 to Dm, for example.

The timing controller 200 and the data driver 300 may be connected through the data clock signal line DCSL and the shared signal line SSL.

In the exemplary embodiment, the timing controller 200 may be connected to the data driving circuits 310 included in the data driver 300 through the data clock signal line DCSL. In an exemplary embodiment, a method in which the timing controller 200 is connected to the data driving circuits 310 included in the data driver 300 through the data clock signal line DCSL may be a point-to-point method, for example. The data clock signal line DCSL may include sub-data clock signal lines corresponding to the number of the data driving circuits 310. Accordingly, the timing controller 200 may be connected to the data driving circuits 310 through the sub-data clock signal lines, respectively.

The data clock signal line DCSL may correspond to an interface (for example, USI or USI-T) for transmitting the data control signal DCS provided from the timing controller 200 to the data driver 300 (or data driving circuits 310). In an exemplary embodiment, the data control signal DCS may be data in which a clock is embedded, for example. In an exemplary embodiment, the data control signal DCS may include the clock control signal supplied from the timing controller 200 to the data driver 300 in the first period (or the vertical blank period) and the image data supplied from the timing controller 200 to the data driver 300 in the second period (or the active data period ADP), for example. In this case, since the timing controller 200 and the data driving circuits 310 included in the data driver 300 are connected through the data clock signal lines DCSL, the timing controller 200 may supply the data control signal DCS corresponding to each of the data driving circuits 310 through the data clock signal line DCSL In the exemplary embodiment, the timing controller 200 may be commonly connected to the data driving circuits 310 included in the data driver 300 through the shared signal line SSL. In an exemplary embodiment, a method in which the timing controller 200 is connected to the data driving circuits 310 included in the data driver 300 through the shared signal line SSL may be a multi drop method, for example.

The shared signal line SSL may correspond to a bidirectional signal transmission channel provided between the timing controller 200 and the data driver 300 (or the data driving circuits 310). The shared signal line SSL may correspond to a signal transmission line for transmitting the first control signal SFC (or a training notification signal) provided from the timing controller 200 to the data driver 300 (or the data driving circuits 310), and the second control signal SBC (or the feedback signal) provided from the data driver 300 (or the data driving circuits 310) to the timing controller 200. In an exemplary embodiment, in a time duration in which the timing controller 200 supplies the clock training signal to the data driver 300 through the data clock signal line DCSL during the first period, the timing controller 200 may supply the first control signal SFC of the first level (or logic low level) to the data driver 300 through the shared signal line SSL so as to notify the supply of the clock training signal, for example. In addition, the data driver 300 may supply the second control signal SBC indicating the reception state of the data driver 300 to the timing controller 200 through the same shared signal line SSL as the transmission channel of the first control signal SFC in the second period.

Since the timing controller 200 and the data driving circuits 310 included in the data driver 300 are commonly connected through the shared signal line SSL, the timing controller 200 may simultaneously supply the first control signal SFC of the first level (or logic low level) for the supply notification of the clock training signal to all of the data driving circuits 310 through one shared signal line SSL in the first period.

In addition, when the reception state of at least one of the data driving circuits 310 included in the data driver 300 is an abnormal state (for example, a lock fail state of the clock signal) in the second period, at least one data driving circuit 310 being in an abnormal reception state may supply the second control signal SBC of a fourth level (or logic low level) to the timing controller 200 through the shared signal line SSL. In this case, the timing controller 200 may re-supply the data the clock training signal to the data driving circuits 310 included in the data driver 300 through the clock signal line DCSL based on the second control signal SBC of the fourth level (or logic low level) supplied from the at least one data driving circuit 310 being in the abnormal reception state in the second period.

The data driving circuits 310 may regenerate the clock signal based on the clock training signal re-supplied from the timing controller 200. In this case, during a period in which the clock signal is regenerated in the second period, the data driving circuits 310 stop generating data voltages corresponding to an image of a current frame, so that corresponding pixels may emit light with grays corresponding to data voltages corresponding to an image of a previous frame. When at least one data driving circuit 310 being in an abnormal reception state supplies the second control signal SBC of the fourth level (or logic low level) to the timing controller 200 through the shared signal line SSL to which the data driving circuits 310 are commonly connected, the data driving circuits 310 may regenerate the clock signal based on the clock training signal re-supplied from the timing controller 200 even without receiving a separate first control signal SFC of the first level (or logic low level) from the timing controller 200.

However, the invention is not limited thereto, and when at least one of the data driving circuits 310, which is in an abnormal reception state, supplies the second control signal SBC of the fourth level (or logic low level) to the timing controller 200, the timing controller 200 may re-supply the first control signal SFC of the first level (or logic low level) for an alarm of the clock training signal supply to the data driving circuits 310, and the data driving circuits 310 may regenerate the clock signal based on the first control signal SFC of the first level (or logic low level) re-supplied from the timing controller 200 in the second period and the clock training signal.

As described above with reference to FIG. 2, since the timing controller 200 and the data driver 300 do not transmit the first control signal SFC for notifying the supply of the clock training signal in the first period and the second control signal SBC indicating the reception state of the data driver 300 (or the data driving circuits 310) in the second period through different signal channels but transmits them through the shared signal line SSL, which is one bidirectional signal channel, it is possible to reduce the number of signal channels for transmitting the first and second control signals SFC and SBC.

Figure 3:
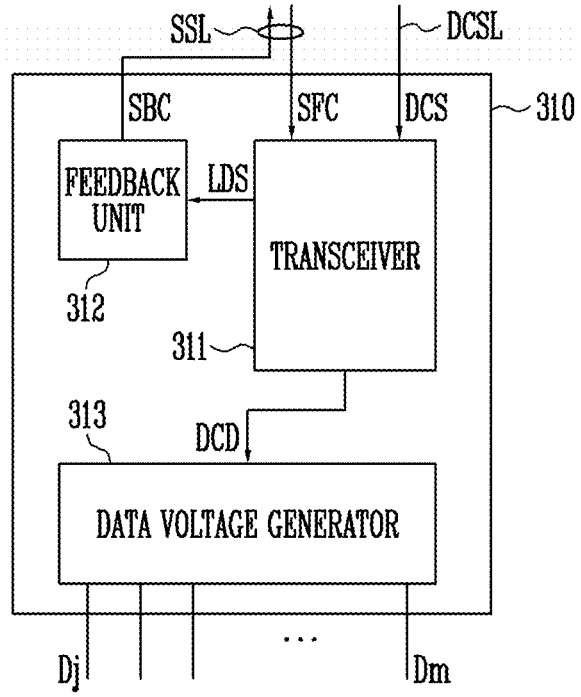
FIG. 3 illustrates a schematic view of a data driving circuit included in the data driver of FIG. 2.

FIG. 3 illustrates a schematic view of a data driving circuit included in the data driver of FIG. 2.

Referring to FIG. 3, the data driving circuit 310 may include a transceiver 311, a feedback unit 312, and a data voltage generator 313.

The transceiver 311 may receive the data control signal DCS from the timing controller 200 (refer to FIG. 2) through the data clock signal line DCSL, and the first control signal SFC from the timing controller 200 (refer to FIG. 2) through the shared signal line SSL.

In the exemplary embodiment, in at least one time duration of the first period (or vertical blank period), the transceiver 311 may receive the clock training signal as the data control signal DCS from the timing controller 200 (refer to FIG. 2) through the data clock signal line DCSL, and it may be supplied, and may receive the first control signal SFC of the first level (or logic low level) from the timing controller 200 (refer to FIG. 2) through the shared signal line SSL. The transceiver 311 may generate the clock signal based on the clock training signal and the first control signal SFC supplied from the timing controller 200 (refer to FIG. 2). To this end, the transceiver 311 may include the CDR circuit, and the CDR circuit may generate the clock signal based on the clock training signal supplied through the data clock signal line DCSL and the first control signal SFC of the first level (or logic low level) supplied through the shared signal line SSL, in at least one time duration of the first period (or vertical blank period).

Figure 4A:
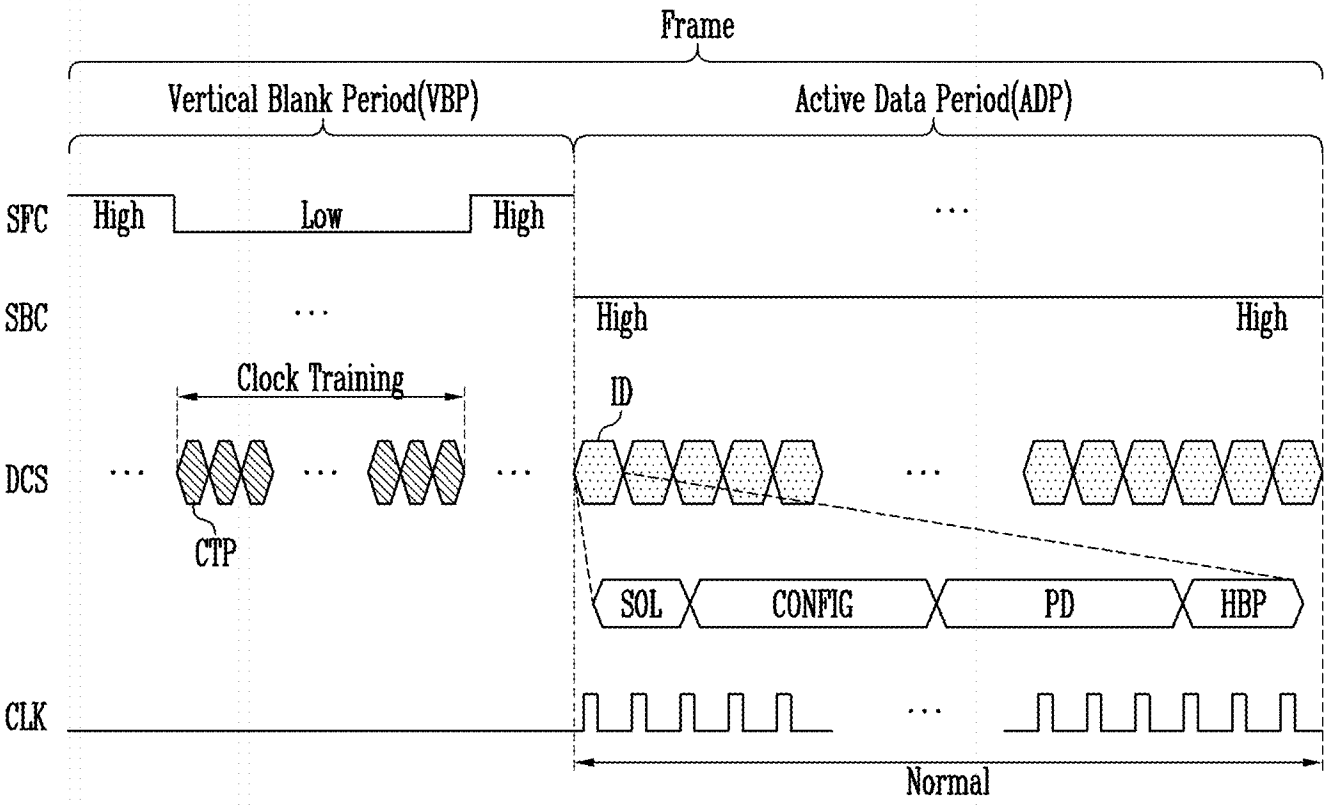
FIG. 4A illustrates a exemplary embodiment of signals transmitted through the data clock signal line and the shared signal line of FIG. 2.
Figure 4B:
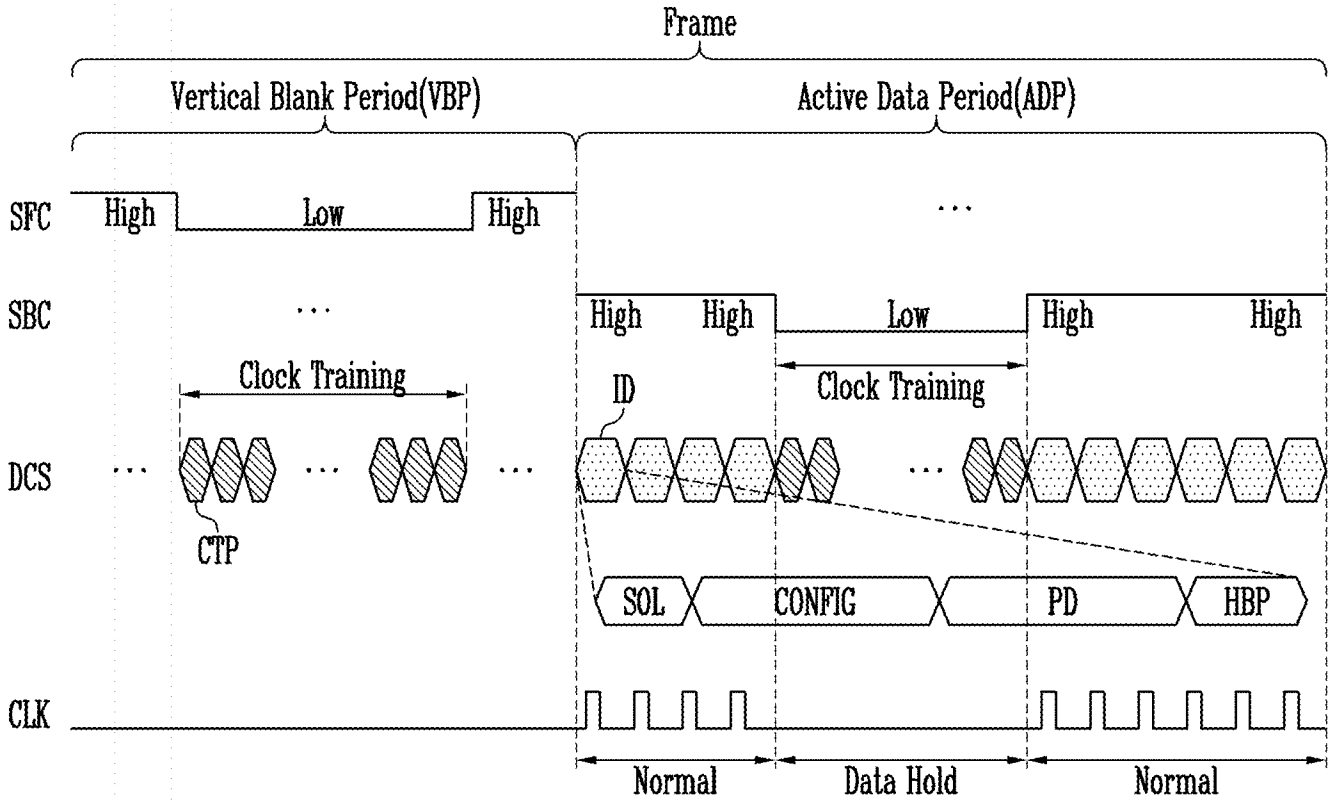
FIG. 4B illustrates another exemplary embodiment of signals transmitted through the data clock signal line and the shared signal line of FIG. 2.

In the exemplary embodiment, the transceiver 311 may receive the image data as the data control signal DCS from the timing controller 200 (refer to FIG. 2) through the data clock signal line DCSL in the second period (or active data period ADP in FIGS. 4A and 4B). The transceiver 311 may sample a data signal DCD from the image data supplied from the timing controller 200 (refer to FIG. 2) by the clock signal generated in the first period. The transceiver 311 may provide the sampled data signal DCD to the data voltage generator 313. In an exemplary embodiment, in the second period, the transceiver 311 may sequentially provide gray values of pixels included in the data signal DCD to the data voltage generator 313, for example.

The transceiver 311 may generate a lock detection signal LDS indicating whether or not the lock fail of the clock signal occurs, and provide the lock detection signal LDS to the feedback unit 312. In an exemplary embodiment, when the lock of the clock signal fails in the second period (or when the reception state of the transceiver is abnormal), the transceiver 311 may generate the lock detection signal LDS, and may provide the generated lock detection signal LDS to the feedback unit 312, for example. In an alternative exemplary embodiment, the transceiver 311 may not generate the lock detection signal LDS when the lock fail of the clock signal does not occur (or when the reception state of the transceiver is normal). To this end, the transceiver 311 may include a lock detector, and when the lock of the clock signal fails in the second period, the lock detector may generate the lock detection signal LDS.

The feedback unit 312 may supply the second control signal SBC to the timing controller 200 (refer to FIG. 2) through the shared signal line SSL based on the lock detection signal LDS provided from the transceiver 311. In an exemplary embodiment, when the lock fail of the clock signal occurs in the second period, the feedback unit 312 may supply the second control signal SBC of the fourth level (or logic low level) to the timing controller 200 (refer to FIG. 2) through the shared signal line SSL based on the lock detection signal LDS provided from the transceiver 311, for example. In contrast, when the lock fail of the clock signal does not occur in the second period, since the lock detection signal LDS is not provided from the transceiver 311, the feedback unit 312 may supply the second control signal SBC of the third level (or logic high level) to the timing controller 200 (refer to FIG. 2) through the shared signal line SSL.

Although the transceiver 311 and the feedback unit 312 are illustrated as separate constituent elements in FIG. 3, since this is merely an example for convenience of description, the invention is not limited thereto, and the transceiver 311 and the feedback unit 312 may be integrated into one configuration.

The data voltage generator 313 may receive the data signal DCD from the transceiver 311. The data voltage generator 313 may generate data voltages by the control signals and gray values included in the data signal DCD, and may supply the generated data voltages to the data lines Dj to Dm connected to the data driving circuit 310. Here, j may be a natural number less than m.

FIG. 4A illustrates an exemplary embodiment of signals transmitted through the data clock signal line and the shared signal line of FIG. 2, and FIG. 4B illustrates another exemplary embodiment of signals transmitted through the data clock signal line and the shared signal line of FIG. 2.

Referring to FIGS. 2 to 4A, the timing controller 200 may supply the first control signal SFC of the first level (or logic low level) for notifying the supply of the clock training signal CTP in at least one time duration of the first period VBP corresponding to the vertical blank period to the data driving circuits 310 through the shared signal line SSL. In addition, the timing controller 200 may supply the first control signal SFC of the second level (or logic high level) to the data driving circuits 310 through the shared signal line SSL in the remaining period of the first period VBP. The timing controller 200 may not supply the first control signal SFC to the data driving circuits 310 in the second period ADP. However, the invention is not limited thereto, and the timing controller 200 may supply the first control signal SFC of the second level (or logic high level) to the data driving circuits 310 in the second period ADP.

In at least one time duration of the first period VBP (e.g., in a time duration of the first period VBP in which the timing controller 200 supplies the first control signal SFC of the first level (or logic low level) to the data driving circuits 310), the timing controller 200 may supply the clock training signal CTP to the data driving circuits 310 through the data clock signal line DCSL. In an exemplary embodiment, the clock training signal CTP may include a clock training pattern, for example.

The data driving circuits 310 may generate the clock signal CLK based on the clock training signal CTP supplied from the timing controller 200 when the first control signal SFC of the first level (or logic low level) is supplied from the timing controller 200 in the first period VBP. In an exemplary embodiment, the transceiver 311 included in each of the data driving circuits 310 may include the CDR circuit, and the CDR circuit may extract a clock embedded in the clock training signal CTP and transmitted in at least one time duration of the first period VBP (that is, in a time duration in which the first control signal SFC of the first level (or logic low level) is supplied in the first period VBP), and may restore a frequency of an internal clock signal of the data driving circuits 310 through the extracted clock to generate the clock signal CLK, for example.

The timing controller 200 may supply the image data ID to the data driving circuits 310 through the data clock signal line DCSL in the second period ADP corresponding to the ADP.

In an exemplary embodiment, each image data ID may include a start of line field SOL, a configuration field CONFIG, pixel data field PD, and a horizontal blank period field HBP, for example.

The start of line field SOL may indicate a start of each line of the image frame displayed in the pixel part 100 (refer to FIG. 1). The data driving circuits 310 may operate an internal counter in response to the start of line field SOL to distinguish between the configuration field CONFIG and the pixel data field PD based on a counting result of the counter. The start of line field SOL may include a code having a specific edge or pattern to be distinguish from the horizontal blank period field HBP for a previous line of a current frame image or the first period (or vertical blank period) between the current frame image and the previous frame image.

The configuration field CONFIG may include configuration data for controlling the data driving circuits 310. The configuration data may include frame configuration data for controlling frame setting of an image frame or line configuration data for controlling setting of each line. In addition, the configuration data may include a frame synchronization signal that is activated when the image data ID for a last line of the image frame is transmitted. The data driving circuits 310 may recognize that the first period (or vertical blank period) starts after the current image data ID is received by receiving the activated frame synchronization signal. In addition, the configuration data may include various types of control data.

The pixel data field PD may include pixel data.

The horizontal blank period field HBP may be a field allocated to secure a time for the data driving circuits 310 to drive the pixel part 100 (refer to FIG. 1) based on the pixel data.

The data driving circuits 310 may receive the image data ID from the timing controller 200 through the data clock signal line DCSL in the second period ADP, and may generate the data voltages based on the image data ID and the clock signal CLK generated in the first period VBP. In an exemplary embodiment, the transceiver 311 included in each of the data driving circuits 310 may sample the pixel data (or the data signal DCD of FIG. 3) included in the image data ID by the clock signal CLK generated in the first period VBP, and the data voltage generator 313 included in each of the data driving circuits 310 may generate the data voltages based on the sampled pixel data (or the data signal DCD of FIG. 3), for example.

The data driving circuits 310 may generate the second control signal SBC indicating the reception state of the data driving circuits 310 in the second period ADP, and may supply the generated second control signal SBC to the timing controller 200 through the shared signal line SSL.

As shown in FIG. 4A, when the reception state of the data driving circuits 310 is in the normal state in the second period ADP, the data driving circuits 310 may supply the second control signal SBC of the third level (or logic high level) to the timing controller 200 through the shared signal line SSL. In an exemplary embodiment, when the lock fail of the clock signal CLK does not occur, the transceiver 311 included in each of the data driving circuits 310 does not generate the lock detection signal LDS, and since the feedback unit 312 included in each of the data driving circuits 310 is not provided with the lock detection signal LDS from the transceiver 311, the feedback unit 312 may supply the second control signal SBC of third level (or logic high level) to the timing controller 200 through the shared signal line SSL, for example. In this case, the timing controller 200 may hold the supply of the image data ID to the data driving circuits 310 through the data clock signal line DCSL for the second period ADP based on the second control signal SBC of the third level (or logic high level) supplied from the data driving circuits 310. Accordingly, the data driving circuits 310 may generate data voltages based on the image data ID supplied through the data clock signal line DCSL for the second period ADP and the clock signal CLK generated in the first period VBP.

In contrast, as shown in FIG. 4B, when the reception state of the data driving circuits 310 is in the abnormal state in the second period ADP, the data driving circuits 310 may supply the second control signal SBC of the fourth level (or logic low level) to the timing controller 200 through the shared signal line SSL. The data driving circuits 310 supplies the second control signal SBC of the third level (or logic high level) through the shared signal line SSL in the second period ADP, and then may supply the second control signal SBC of the fourth level (or logic low level) to the timing controller 200 through the shared signal line SSL when the reception state of the data driving circuits 310 is abnormal. In an exemplary embodiment, the transceiver 311 included in each of the data driving circuits 310 generates the lock detection signal LDS when the lock fail of the clock signal CLK occurs, and it may provide the generated lock detection signal LDS to the feedback unit 312 included in each of the data driving circuits 310, for example. Accordingly, the feedback unit 312 may supply the second control signal SBC of the fourth level (or logic low level) to the timing controller 200 through the shared signal line SSL. In this case, the timing controller 200 may stop the supply of the image data ID to the data driving circuits 310 through the data clock signal line DCSL for a time duration of the second period ADP in which the second control signal SBC of the fourth level (or logic low level) is supplied, based on the second control signal SBC of the fourth level (or logic low level) supplied from the data driving circuits 310. In addition, in the second period ADP, the timing controller 200 may re-supply the clock training signal CTP to the data driving circuits 310 through the data clock signal line DCSL based on the second control signal SBC of the fourth level (or logic low level) supplied from the data driving circuits 310. Accordingly, the data driving circuits 310 may regenerate the clock signal CLK based on the clock training signal CTP re-supplied through the data clock signal line DCSL, for a time duration of the second period ADP in which the second control signal SBC of the fourth level (or logic low level) is supplied.

During the period of the second period ADP in which the timing controller 200 re-supplies the clock training signal CTP to the data driving circuits 310, even though the timing controller 200 does not supply the first control signal SFC of the first level (or logic low level) to the data driving circuits 310 as in the first period VBP, when at least one of the data driving circuits 310 in which the reception state is abnormal supplies the second control signal SBC of the fourth level (or logic low level) to the timing controller 200 through the shared signal line SSL, since the shared signal line SSL is commonly connected to the data driving circuits 310 as shown in FIG. 2, all of the data driving circuits 310 may regenerate the clock signal CLK through the clock training signal CTP re-supplied through the timing controller 200, based on the second control signal SBC of the fourth level (or logic low level). However, the invention is not limited thereto, and when at least one of the data driving circuits 310, which is in an abnormal reception state, supplies the second control signal SBC of the fourth level (or logic low level) to the timing controller 200, the timing controller 200 may re-supply the first control signal SFC of the first level (or logic low level) for an alarm of the clock training signal supply to the data driving circuits 310 through the shared signal line SSL, and the data driving circuits 310 may regenerate the clock signal CLK based on the first control signal SFC of the first level (or logic low level) re-supplied from the timing controller 200 in the second period ADP and the clock training signal CTP.

Thereafter, when the reception state of the data driving circuits 310 becomes normal again (when the lock of the clock signal CLK succeeds), the data driving circuits 310 may supply the second control signal SBC of the third level (or logic high level) to the timing controller 200 through the shared signal line SSL. Accordingly, the timing controller 200 may re-supply the image data ID to the data driving circuits 310 through the data clock signal line DCSL, and the data driving circuits 310 may generate the data voltages based on the re-supplied image data ID and the regenerated clock signal CLK As described above with reference to FIGS. 2 to 4B, when the reception state of the data driver 300 becomes the abnormal state (for example, when the lock fail of the clock signal CLK occurs) in the second period ADP, the data driver 300 (or the data driving circuits 310) provides the second control signal SBC of the fourth level (or logic low level) to the timing controller 200, so that the timing controller 200 re-supplies the clock training signal CTP to the data driver 300 even in the second period ADP corresponding to the active data period ADP, thus the data driver 300 may regenerate the clock signal CLK based on the re-supplied clock training signal CTP. In this case, as a signal channel connected between the timing controller 200 and the data driver 300, the shared signal line SSL, which corresponds to one bidirectional signal channel that transmits the first control signal SFC for notifying the supply of the clock training signal in the first period VBP and the second control signal SBC indicating the reception state of the data driver 300 in the second period ADP, is used, thus the number of signal channels for signal transmission between the timing controller 200 and the data driver 300 may be reduced.

Figure 5:
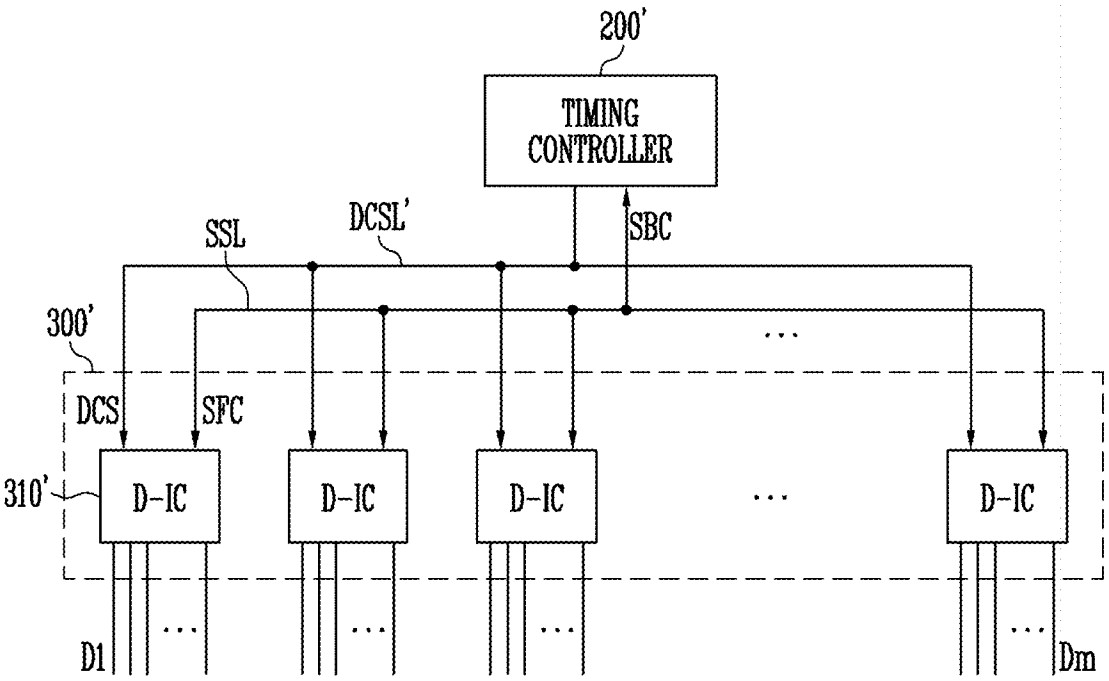
FIG. 5 illustrates another exemplary embodiment of a timing controller, a data driver, and a data clock signal line and a shared signal line connecting the timing controller and the data driver included in the display device of FIG. 1.

FIG. 5 illustrates another exemplary embodiment of a timing controller, a data driver, and a data clock signal line and a shared signal line connecting the timing controller and the data driver included in the display device of FIG. 1.

Referring to FIGS. 2 and 5, except for a connection method of a data clock signal line DCSL' connected between a timing controller 200' and a data driver 300', the timing controller 200', the data driver 300', data driving circuits 310', and a shared signal line SSL of FIG. 5 are substantially the same as or similar to the timing controller 200, the data driver 300, the data driving circuits 310, and the shared signal line SSL of FIG. 2, respectively, so a duplicated description will not be repeated.

Referring to FIG. 5, the data driver 300' may include the data driving circuits 310'.

The timing controller 200' and the data driver 300' may be connected through the data clock signal line DCSL'.

In the exemplary embodiment, the timing controller 200' may be commonly connected to the data driving circuits 310' included in the data driver 300' through the data clock signal line DCSL'. In an exemplary embodiment, a method in which the timing controller 200' is connected to the data driving circuits 310' included in the data driver 300' through the data clock signal line DCSL' may be a multi drop method, for example. As such, the timing controller 200' and the data driver 300' are commonly connected through the data clock signal line DCSL', so that the number of pins or pads for the data clock signal line DCSL' to be connected to the timing controller 200' may be reduced.

Figure 6:
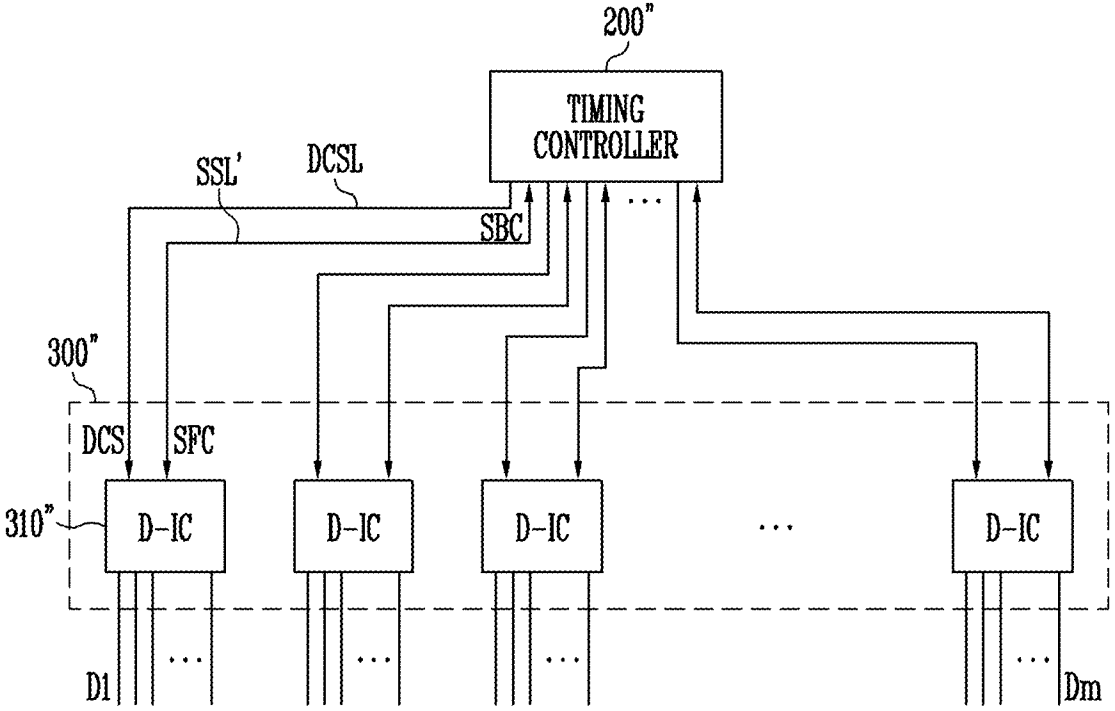
FIG. 6 illustrates another exemplary embodiment of a timing controller, a data driver, and a data clock signal line and a shared signal line connecting the timing controller and the data driver included in the display device of FIG. 1.

FIG. 6 illustrates another exemplary embodiment of a timing controller, a data driver, and a data clock signal line and a shared signal line connecting the timing controller and the data driver included in the display device of FIG. 1.

Referring to FIGS. 2 and 6, except for a connection method of a shared signal line SSL' connected between a timing controller 200" and a data driver 300", the timing controller 200", the data driver 300", data driving circuits 310", and a data clock signal line DCSL of FIG. 6 are substantially the same as or similar to the timing controller 200, the data driver 300, the data driving circuits 310, and the data clock signal line DCSL of FIG. 2, respectively, so a duplicated description will not be repeated.

Referring to FIG. 6, the data driver 300" may include the data driving circuits 310".

The timing controller 200" and the data driver 300" may be connected through the shared signal line SSL'.

In the exemplary embodiment, the timing controller 200" may be connected to the data driving circuits 310" included in the data driver 300" through the shared signal line SSL', respectively. In an exemplary embodiment, a method in which the timing controller 200" is connected to the data driving circuits 310" included in the data driver 300" through the shared signal line SSL' may be a point-to-point method, for example. In an exemplary embodiment, the shared signal line SSL' may include sub-shared signal lines corresponding to the number of the data driving circuits 310". Accordingly, the timing controller 200" may be connected to the data driving circuits 310" through the sub-shared signal lines, respectively.

The sub-shared signal lines included in the shared signal line SSL' may respectively correspond to bidirectional signal transmission channels provided between the timing controller 200" and the data driver 300" (or the data driving circuits 310"). The sub-shared signal lines may respectively correspond to signal transmission channels for transmission of first control signals SFC provided from the timing controller 200" to each of the data driving circuits 310" and for transmission of second control signals SBC provided from each of the data driving circuits 310" to the timing controller 200".

Since the timing controller 200" is connected to the data driving circuits 310" through the sub-shared signal lines included in the shared signal line SSL', respectively, the timing controller 200" may respectively supply the first control signals SFC of the first level (or logic low level) for notifying the supply of the clock training signal to the data driving circuits 310" through the sub-shared signal lines. In this case, in the first period (for example, the first period VBP of FIGS. 4A and 4B), the timing controller 200" may simultaneously supply the first control signals SFC of the first level (or logic low level) to the data driving circuits 310" through the sub-shared signal lines. Accordingly, the data driving circuits 310" may generate the clock signal in a time duration in which the first control signals SFC of the first level (or logic low level) are supplied, based on the first control signals SFC of the first level (or logic low level) and the clock training signal CTP of the first level (or logic low level) supplied from the timing controller 200".

The data driving circuits 310" may supply the second control signal SBC indicating the reception state of the data driving circuits 310" in the second period (for example, the second period ADP of FIGS. 4A and 4B) to the timing controller 200" through the same shared signal line SSL as the transmission channel of the first control signal SFC. In this case, since the timing controller 200" is connected to the data driving circuits 310" through the sub-shared signal lines included in the shared signal line SSL', respectively, each of the data driving circuits 310" may supply the second control signals SBC different from each other to the timing controller 200" through the connected sub-shared signal lines.

In the exemplary embodiment, the data driving circuits 310" of which the reception state is in an abnormal state (for example, a lock fail state of the clock signal) in the second period may supply the second control signals SBC of the fourth level (or logic low level) to the timing controller 200" through corresponding sub-shared signal lines. In this case, based on the second control signals SBC of the fourth level (or logic low level) supplied from the data driving circuits 310" of which the reception state is abnormal in the second period, the timing controller 200" may stop the supply of the image data to the data driving circuits 310" that supply the second control signals SBC of the fourth level (or logic low level), and may re-supply the clock training signal through the data clock signal line DCSL. In this case, similar to the shared signal line SSL', the data clock signal line DCSL also includes sub-data clock signal lines, and since the timing controller 200" and the data driving circuit 310" are connected to each other through the sub-data clock signal lines, the timing controller 200" may re-supply the clock training signal only to the data driving circuits 310" of which the reception state is abnormal through the sub-data clock signal lines that correspond to the data driving circuits 310 that supply the second control signals SBC of the fourth level (or logic low level). Accordingly, the data driving circuits 310" of which the reception state is abnormal may stop the generation of the data voltages, may be re-supplied with the clock training signal from the timing controller 200", and may regenerate the clock signal based on the re-supplied clock training signal.

In an alternative exemplary embodiment, the data driving circuits 310" of which the reception state is in a normal state in the second period may supply the second control signals SBC of the third level (or logic high level) to the timing controller 200" through corresponding sub-shared signal lines. In this case, based on the second control signals SBC of the third level (or logic high level) supplied from the data driving circuits 310" of which the reception state is normal in the second period, the timing controller 200" may maintain the supply of the image data to the data driving circuits 310", which supply the second control signals SBC of the third level (or logic high level), through the data clock signal line DCSL (or corresponding sub-data clock signal lines). Accordingly, the data driving circuits 310" of which the reception state is normal may continue to generate the data voltages, based on the image data supplied through the data clock signal line DCSL (or corresponding sub-data clock signal lines) and the clock signal generated in the first period. As such, since the timing controller 200" is connected to the data driving circuits 310" through the sub-shared signal lines included in the shared signal line SSL', respectively, the timing controller 200" re-supplies the clock training signal only to the data driving circuits 310" of which the reception state is abnormal in the second period, so that only the data driving circuits 310" of which the reception state is abnormal may stop the generation of the data voltages. Therefore, only the pixels corresponding to the data driving circuits 310" of which the reception state is abnormal emit light with grays corresponding to the data voltages corresponding to the image of the previous frame, and since the data driving circuits 310" of which the reception state is normal generate the data voltages based on the image data and the clock signal supplied from the timing controller 200", the pixels corresponding to the data driving circuits 310" of which the reception state is normal may receive the data voltages corresponding to the image of the current frame and emit light with grays corresponding thereto. Accordingly, as the data driving circuits 310" regenerate the clock signal in the second period, it is possible to improve display defects caused by the pixels emitting light with the grays corresponding to the data voltages corresponding to the image of the previous frame.

The above-detailed description illustrates and explains the invention. In addition, the above-detailed description merely illustrates exemplary embodiments of the invention, the invention may be used in various other combinations, changes, and environments as described above, and the scope of the invention disclosed herein may be changed or modified within the scope of equivalents and/or techniques or knowledge in the art. Therefore, the above-detailed description is not intended to limit the invention to the disclosed exemplary embodiments. In addition, the appended claims should be construed to include other exemplary embodiments.

What is claimed is:

1. A display device comprising:

a data clock signal line;

a shared signal line;

a timing controller which supplies a clock training signal through the data clock signal line and a first control signal through the shared signal line in a first period of one frame, and supplies image data through the data clock signal line in a second period of the one frame;

a data driver including data driving circuits which generate a clock signal based on the clock training signal and the first control signal in the first period, and generate data voltages based on the clock signal and the image data in the second period; and a pixel part which receives the data voltages from the data driver, wherein the data driver supplies a second control signal which indicates a reception state of the data driver to the timing controller through the shared signal line in the second period.

2. The display device of claim 1, wherein the timing controller re-supplies the clock training signal to the data driver through the data clock signal line based on the second control signal in the second period.

3. The display device of claim 1, wherein the timing controller supplies the first control signal of a first level to the data driver through the shared signal line in a first time duration of the first period, and supplies the first control signal of a second level higher than the first level to the data driver through the shared signal line in a second time duration of the first period different from the first time duration.

4. The display device of claim 3, wherein the data driver generates the clock signal based on the clock training signal and the first control signal of the first level in the first time duration of the first period.

5. The display device of claim 2, wherein the timing controller is commonly connected to the data driving circuits through the shared signal line.

6. The display device of claim 5, wherein:

when the reception state is normal in the second period, the data driver supplies the second control signal of a third level to the timing controller through the shared signal line; and when the reception state is abnormal in the second period, the data driver supplies the second control signal of a fourth level lower than the third level to the timing controller through the shared signal line.

7. The display device of claim 6, wherein, when the second control signal of the fourth level is supplied from the data driver in the second period, the timing controller stops the supply of the image data, and re-supplies the clock training signal to the data driver through the data clock signal line.

8. The display device of claim 7, wherein, when the clock training signal is re-supplied from the timing controller in the second period, the data driver stops generation of the data voltages, and re-generates the clock signal based on the re-supplied clock training signal.

9. The display device of claim 6, wherein, when the second control signal of the third level is supplied from the data driver in the second period, the timing controller holds the supply of the image data.

10. The display device of claim 9, wherein, when the data driver supplies the second control signal of the third level to the timing controller in the second period, the data driver generates the data voltages based on the clock signal and the image data.

11. The display device of claim 6, wherein the abnormal state is based on a lock fail of the clock signal.

12. The display device of claim 2, wherein:

the shared signal line includes sub-shared signal lines, and the timing controller is connected to the data driving circuits through the sub-shared signal lines, respectively.

13. The display device of claim 12, wherein:

a first data driving circuit of the data driving circuits, in which the reception state is normal in the second period, supplies the second control signal of a third level to the timing controller through a first sub-shared signal line of the sub-shared signal lines; and a second data driving circuit of the data driving circuits, in which the reception state is abnormal in the second period, supplies the second control signal of a fourth level lower than the third level to the timing controller through a second sub-shared signal line of the sub-shared signal lines.

14. The display device of claim 13, wherein the timing controller stops the supply of the image data to the data driving circuits, which supplies the second control signal of the fourth level, and re-supplies the clock training signal through the data clock signal line, in the second period.

15. The display device of claim 14, wherein the data driving circuits re-supplied with the clock training signal in the second period stop the generation of the data voltages, and regenerate the clock signal based on the re-supplied clock training signal.

16. The display device of claim 13, wherein the timing controller holds the supply of the image data to the data driving circuits which supplies the second control signal of the third level in the second period.

17. The display device of claim 16, wherein the data driving circuits which supply the second control signal of the third level to the timing controller in the second period generate the data voltages based on the clock signal and the image data.

18. The display device of claim 1, wherein the shared signal line is able to transmit a bidirectional signal between the timing controller and the data driver.

19. The display device of claim 1, wherein the timing controller is commonly connected to the data driving circuits through the data clock signal line.

20. The display device of claim 1, wherein:

the data clock signal line includes sub-data clock signal lines, and the timing controller is connected to the data driving circuits through the sub-data clock signal lines, respectively.

* * * * *